US007607974B2

(12) United States Patent
Jones et al.

(10) Patent No.: US 7,607,974 B2
(45) Date of Patent: Oct. 27, 2009

(54) ROOFTOP VENT FOR REDUCING PRESSURE UNDER A MEMBRANE ROOF

(75) Inventors: James R. Jones, Blacksburg, VA (US); Demetri Telionis, Blacksburg, VA (US); Pavlos Vlachos, Blacksburg, VA (US); Elizabeth Grant, Blacksburg, VA (US); Jose Rullan, Blacksburg, VA (US); Charles S. Johnson, Wytheville, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 1003 days.

(21) Appl. No.: 11/177,492

(22) Filed: Jul. 11, 2005

(65) Prior Publication Data

US 2006/0005479 A1 Jan. 12, 2006

Related U.S. Application Data

(63) Continuation-in-part of application No. 10/807,412, filed on Mar. 24, 2004, now Pat. No. 7,001,266.

(60) Provisional application No. 60/466,441, filed on Apr. 30, 2003.

(51) Int. Cl.
*E04D 13/03* (2006.01)

(52) U.S. Cl. ..... 454/364; 454/365; 52/199

(58) Field of Classification Search ..... 454/364–365; 52/198–199

See application file for complete search history.

(56) References Cited

U.S. PATENT DOCUMENTS 1,122,375 A 12/1914 Engle
1,122,431 A 12/1914 Sexton
2,387,708 A * 10/1945 Arnhym ..... 454/116
3,302,552 A 2/1967 Walsh
3,347,147 A * 10/1967 Howard ..... 454/38
3,509,811 A 5/1970 Topp
3,685,426 A 8/1972 Rosa
3,788,207 A 1/1974 Doherty, II
3,817,009 A 6/1974 Elder
3,893,383 A 7/1975 Jones
3,984,947 A 10/1976 Patry
4,016,730 A 4/1977 Devilliers
4,162,597 A 7/1979 Kelly
4,223,486 A 9/1980 Kelly
4,512,243 A 4/1985 Ballard et al.
4,538,508 A 9/1985 Ballard
4,557,081 A 12/1985 Kelly (Continued)

*Primary Examiner*—Steve McAllister
*Assistant Examiner*—Helena Kosanovic
(74) *Attorney, Agent, or Firm*—Blank Rome LLP

(57) ABSTRACT

Membrane roofs are susceptible to damage in high winds. Wind can lift a membrane roof from a building and cause it to tear or become damaged. The present roof vent prevents liftoff and damage by reducing the air pressure under the membrane during high winds. The present roof vent has two opposed convex domes separated by a gap. Wind blowing across the roof flows between the domes where it accelerates and creates a region of low pressure according to the Venturi effect. The lower dome has an opening at the gap so that the low pressure is applied to the space under the membrane roof. Therefore, when wind blows across the roof, the vent draws air from under the membrane and the membrane is pressed against the roof, preventing liftoff.

17 Claims, 4 Drawing Sheets

U.S. PATENT DOCUMENTS

| | | | |
|---|---|---|---|
| 4,593,504 | A | 6/1986 | Bonnici et al. |
| 4,608,792 | A | 9/1986 | Gerber |
| 4,641,571 | A | 2/1987 | Anderson et al. |
| 4,652,321 | A | 3/1987 | Greko |
| 4,803,111 | A | 2/1989 | Mansell |
| 4,848,653 | A | 7/1989 | Van Becelaere |
| 4,850,166 | A | 7/1989 | Taylor |
| 4,876,950 | A | 10/1989 | Rudeen |
| 4,888,930 | A | 12/1989 | Kelly |
| 4,909,135 | A | 3/1990 | Greko |
| 4,963,761 | A | 10/1990 | Wight |
| 5,009,149 | A | 4/1991 | MacLeod et al. |
| 5,734,215 | A | 3/1998 | Taghezout et al. |
| 5,749,780 | A | 5/1998 | Harder et al. |
| 5,766,071 | A | 6/1998 | Kirkwood |
| 6,006,482 | A | 12/1999 | Kelly |
| 6,325,712 | B1 | 12/2001 | Lawless, III et al. |
| 6,484,459 | B1 | 11/2002 | Platts |
| 2005/0054281 | A1* | 3/2005 | Lin ..... 454/116 |

* cited by examiner

ROOFTOP VENT FOR REDUCING PRESSURE UNDER A MEMBRANE ROOF

CROSS-REFERENCE TO RELATED APPLICATIONS

This application is a continuation-in-part (CIP) of U.S. Ser. No. 10/807,412 filed Mar. 24, 2004 now U.S. Pat. No. 7,001,266, and claims priority to U.S. Provisional Patent Application Ser. No. 60/466,441 filed Apr. 30, 2003, and the complete contents of each application is herein incorporated by reference.

FIELD OF THE INVENTION

The present invention relates generally to rooftop vents, and, more specifically, to a vent for reducing pressure under a membrane roof during windstorms.

BACKGROUND OF THE INVENTION

Membrane roof systems are commonly used in low-slope roofs. A membrane roof typically comprises a rubber or plastic (e.g., made of PVC) sheet that provides a moisture and vapor barrier. Membrane roofs are relatively inexpensive to install and consequently the use of membrane roof systems has been expanding in recent years.

One problem with membrane roofs is that they are susceptible to damage from high winds. High winds create a reduced air pressure on the top surface of the membrane, which cause it to lift from the building. A membrane roof lifted from the subroof can be torn from the building or damaged in other ways.

Hence, one of the challenges of designing membrane roof systems is providing an attachment method strong enough to prevent uplift of the membrane during high wind conditions. Conventional methods for attachment include mechanical fasteners, adhesive layers or ballast. These methods have a tendency to increase heat transmission through the roof, which increases heating and cooling costs. Also, these methods are not completely reliable in very high winds.

Alternative methods for fastening membrane roofs include a turbine vent system (made by Burke Industries) and a passive vent (made by the 2001 Company). These vent systems provide reduced air pressure under the membrane to hold it in place. However, both these solutions require air-tight deck assemblies for efficient operation and have a relatively high manufacturing cost.

It would be an advance in the art of membrane roof systems to provide a roof that resists uplift in very high wind conditions. It would be particularly beneficial for the roof to be inexpensive, simple to install, and compatible with already installed membrane roofs.

SUMMARY OF THE INVENTION

The present invention provides a roof vent for use with membrane roofs. The present vent includes a lower dome and an upper dome separated by a gap. The domes are shaped and positioned so that the distance between the domes is smallest at the center and greatest at the periphery. This structure induces the Venturi effect when wind blows between the domes. The lower dome has a port that is open to a space under a roof membrane. When wind blows through the present roof vent, low pressure is created at the port by the Venturi effect, and the low pressure is applied to the space under the membrane.

The vent has a horizontal flange on the lower dome for attachment to a roof membrane. The horizontal flange may have feet on its lower surface to lift the vent base above the subroof and allow airflow between the subroof and flange.

Preferably, the port is located where the distance between domes is smallest.

The vent can include a drip edge on the upper dome to prevent water from dripping into the port. The lower dome can include a drip pan and drain to collect and exhaust undesired water that falls into the port.

Also, the present invention includes embodiments where one of the upper dome or lower dome is flat.

The present invention also includes a membrane roof system having a roof membrane in combination with the present roof vent. In the present membrane roof system, a porous layer or grooves can be provided under the membrane so that air can flow under the membrane. This feature maximizes the area of reduced pressure and helps prevent trapped pockets of air under the membrane.

Additionally, the present invention includes embodiments where the port is located in the upper dome. In this case, the upper dome and lower dome are connected by a hollow leg. The hollow leg supports the upper dome and provides an air flow path between the lower dome and the port in the upper dome. The port in the upper dome faces downwardly, which tends to prevent water from infiltrating the roof vent.

DETAILED DESCRIPTION OF THE PREFERRED EMBODIMENTS OF THE INVENTION

The present invention provides a roof vent and roof system that reduces air pressure under a membrane roof when wind blows, thereby holding down the membrane roof. The present roof vent employs the Venturi effect to reduce the pressure under the membrane. The reduced pressure tends to prevent uplift during high wind events. Specifically, the present roof vent has two hollow domes separated by a gap. When wind blows, airflow is forced through the gap between the domes where it creates a zone of low pressure due to the Venturi effect. The bottom dome has a port located at the gap. The port is open to the space under the membrane roof. Therefore, when air flows between the two domes, the low pressure at the port tends to draw air from under the membrane and air pressure under the membrane is reduced to less than the atmospheric pressure.

Figure 1:
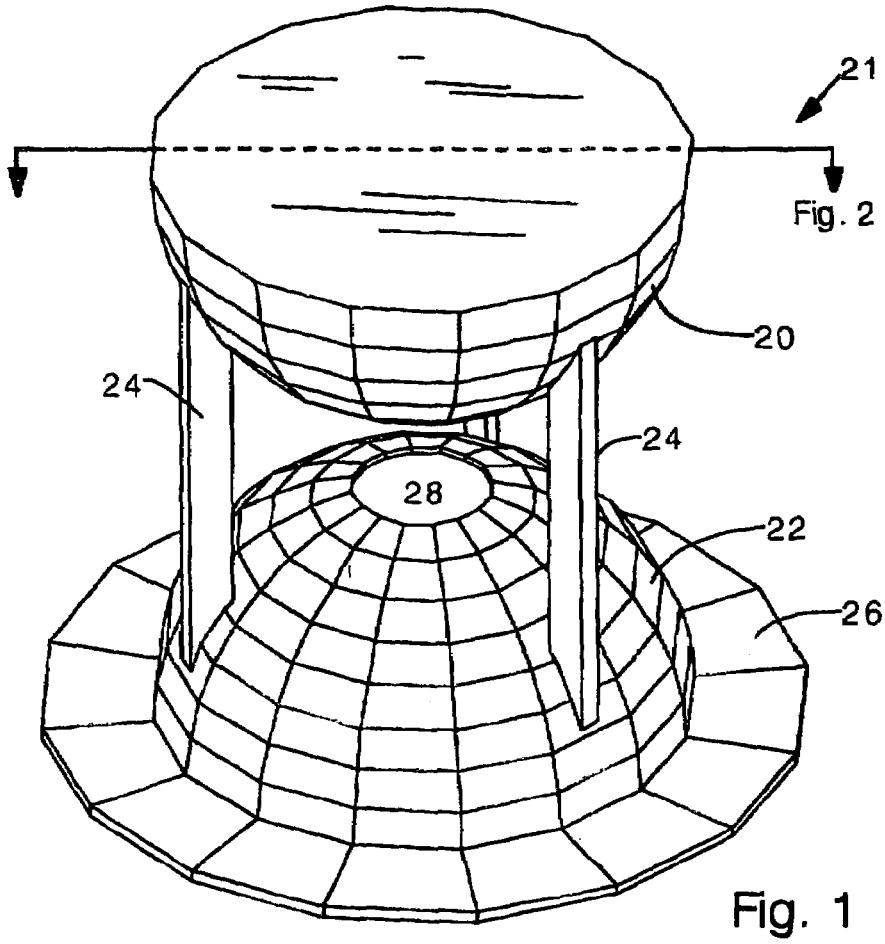
FIG. 1 shows a perspective view of the present membrane roof vent.

FIG. 1 shows a perspective view of the present roof vent 21. The roof vent 21 has an upper dome 20, a lower dome 22 and legs 24. Legs 24 support the upper dome 20 above the lower dome 22. Upper dome 20 is preferably closed on the top, so that it does not collect rainwater. Lower dome 22 preferably has a horizontal flange 26 for attachment to a membrane roof. Lower dome also has a port 28 located at the point closest to the upper dome 20. Both the upper dome 20 and lower dome are hollow.

The entire roof vent can be made of molded plastic such as polypropylene, polycarbonate or PVC. Metal or fiberglass can also be used. Preferably, the vent is made of a material that is resistant to damage from UV exposure.

Upper dome 20 has a bottom surface facing the lower dome 22. The bottom surface can be hemispherical or any other convex shape. Alternatively, the bottom surface is flat. Similarly, the lower dome 22 has a top surface facing the bottom surface of the upper dome 20. The top surface can be hemispherical or any other convex shape. Alternatively, the top surface is flat. At least one of the top surface and bottom surface is convex; both the top surface and bottom surface cannot be flat.

The size of the domes can vary widely. For example, the diameter of the domes can be in the range of 4-12 inches, or larger.

The size of the port 28 can also vary widely. For example, the port can be ⅛ to 2 inches in diameter. The port can also include a porous screen (not shown) so that debris does not accumulate within the lower dome.

Figure 2:
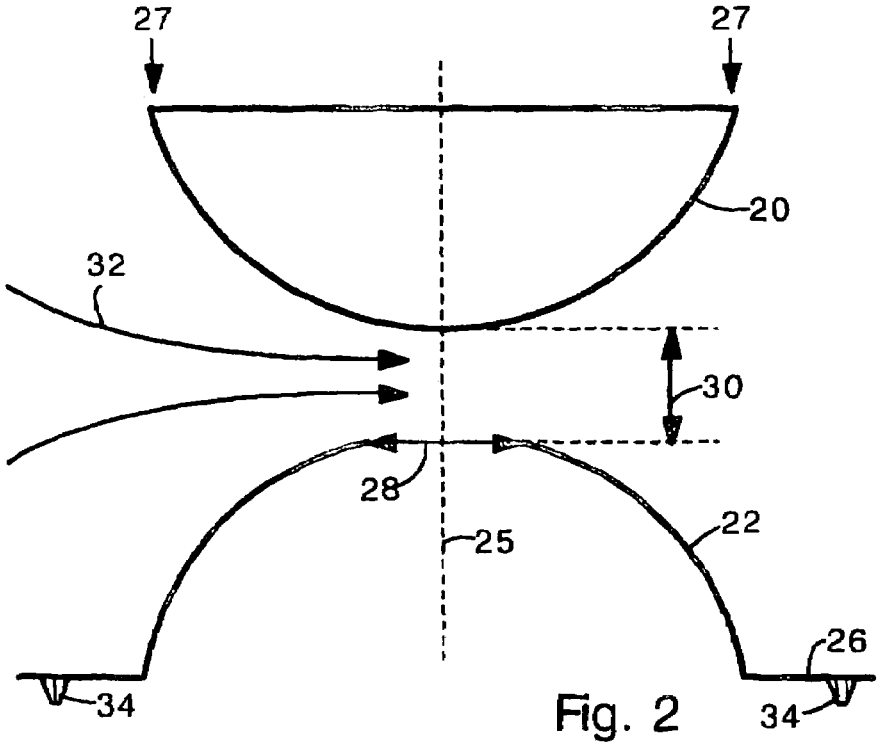
FIG. 2 shows a cross-sectional view of the present membrane roof vent.

FIG. 2 shows a cross sectional view of the present roof vent 21. The domes 20 22 are separated by a gap 30. The size of the gap can vary widely, but will typically be about 1-3 inches for vents with dome diameters of about 10 inches. Preferably, the size of the gap 30 is selected so that the magnitude of air pressure reduction at the port 28 is maximized for typical wind speeds.

The roof vent may have feet 34. Feet 34 provide an airspace under the flange when the vent is placed on a flat surface.

The vent has a center 25 and a periphery 27. Preferably, but not necessarily, the vent is circularly symmetric about the center 25. The gap spacing between the domes 20 22 necessarily decreases from the periphery to the center 25.

Figure 3:
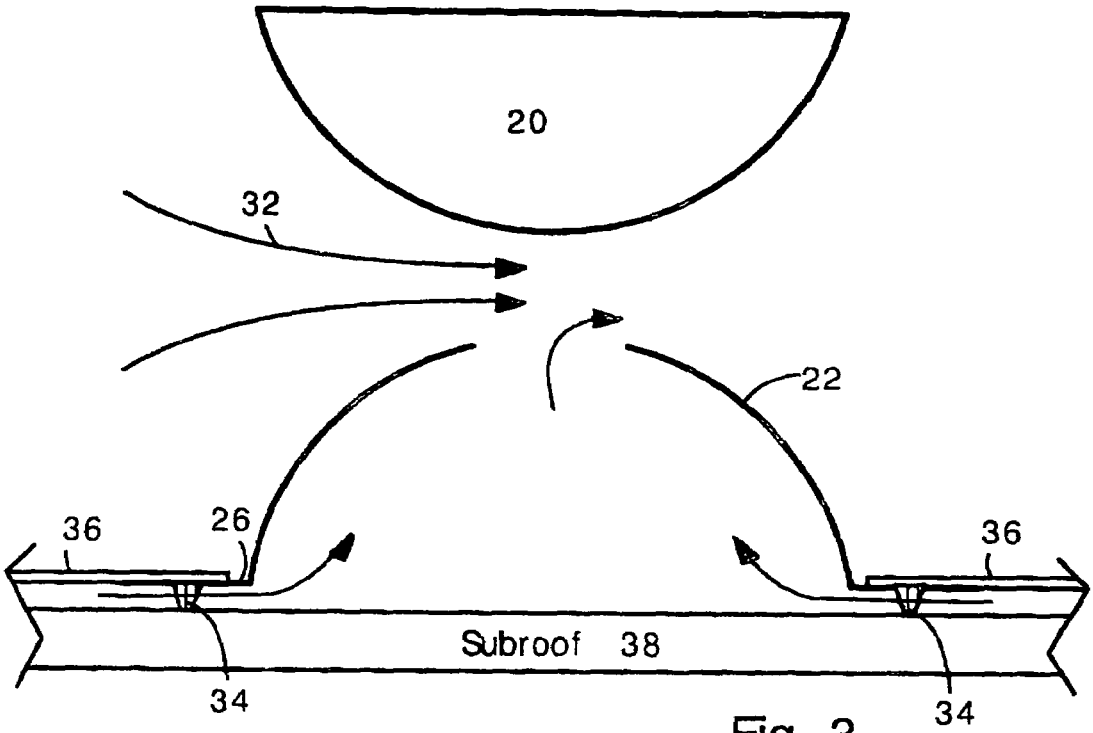
FIG. 3 shows the present roof vent in combination with a membrane roof.

FIG. 3 shows the present roof vent installed in a membrane roof system. The membrane roof includes a plastic membrane 36. A subroof 38 is located under the membrane roof. The subroof typically is a wood, metal, concrete, tectum, gypsum or rigid insulation material and may be covered with tarpaper or similar building materials. The subroof 38 is part of the building structure.

The plastic membrane is typically made of flexible fabric-reinforced PVC, but can also be a thermoplastic or thermoset with or without fabric reinforcement. The membrane 36 has a circular hole with a diameter slightly larger than the diameter of the lower dome 22. The membrane 36 is bonded to the horizontal flange 26 (the flange can be above or below the membrane). The flange 26 and membrane 36 can be bonded by chemical adhesives, solvents or heat, for example. The bond between the flange 26 and membrane 36 must be water tight.

In operation, wind 32 blowing over the membrane roof flows between the domes 20 22. The velocity of the air increases as it flows toward the center 25 as a result of the decrease in distance between the domes. Consequently, the air pressure in the center is reduced according to Bernoulli's law, as known in the art. Low pressure at the port 28 is applied inside the lower dome and to the space under the membrane 36. Air under the membrane flows under the flange 26 between the feet 34 and out through the port 28. In this way, the air pressure under the membrane 36 will always be kept lower than the atmospheric air pressure when wind is blowing. The reduction in air pressure under the membrane tends to press the membrane against the subroof 38, thereby protecting the membrane 36 from liftoff and wind damage.

The air pressure in the lower dome decreases with increasing wind speed. Therefore, the membrane 36 is held down against the subroof 38 with greater force in high winds.

In experiments performed by the present inventors with a vent having 10-inch diameter, hemispheric upper and lower domes separated by 2 inches, a 150 mph windspeed produced a pressure drop equivalent to about 10 inches of water. This pressure reduction is sufficient to prevent liftoff for most typical membrane roofs. These experiments were conducted in a wind tunnel and the size of the gap was varied to determine the optimum gap spacing.

It is noted that the present roof vent is omnidirectional with respect to wind direction. The roof vent provides reduced air pressure for wind blowing in any direction as a result of its circular symmetry.

Figure 4:
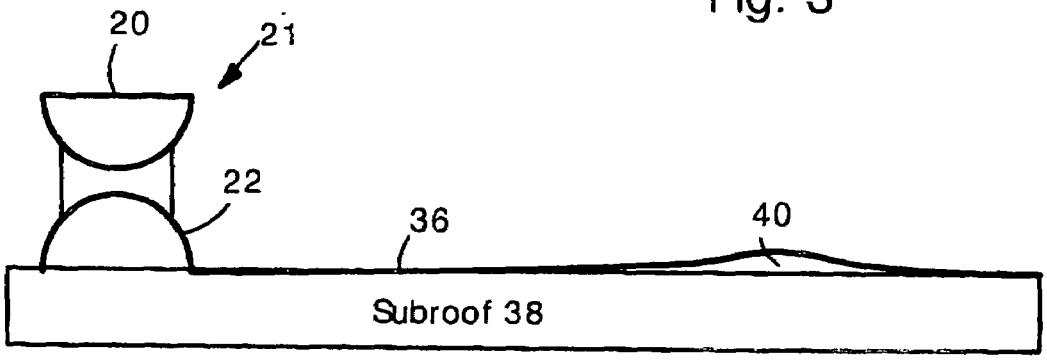
FIG. 4 shows a larger view of a membrane roof with the roof vent and an air pocket under the membrane.

It is important in the present invention to assure that air can flow in the space between the membrane 36 and subroof 38. If, for example, the subroof 38 has a smooth upper surface, then the subroof can form a relatively airtight seal with the membrane 36. Such a seal can trap pockets of air under the membrane 36 and reduce the propagation of the negative pressure zone under the membrane. FIG. 4 illustrates a trapped air pocket 40. The pocket 40 cannot be exhausted by the vent 21 because the membrane 36 and subroof 38 form a seal in the area around the vent 21.

In order to prevent the formation of air pockets 40, tubes or porous mesh can be provided between the subroof 38 and membrane 36. Alternatively, a network of grooves can be formed in the subroof so that the membrane cannot form a seal with the subroof.

Figure 5:
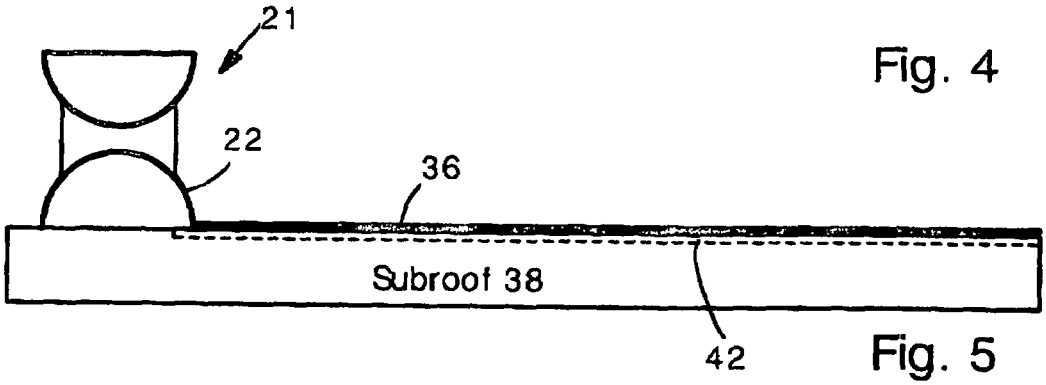
FIG. 5 shows a membrane roof having grooves in the subroof.
Figure 6:
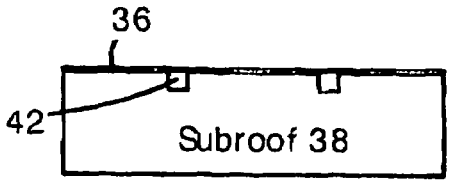
FIG. 6 shows a cross-sectional view of the groove in the subroof.

FIG. 5 illustrates a subroof 38 with a groove 42. The groove 42 extends from the lower dome 22 so that the dome is fluidically connected to the entire area under the membrane 36. FIG. 6 shows a cross sectional view of an exemplary groove. The groove can have dimensions ranging from ⅛ inch square to more than ¼ inch square, for example.

Figure 7:
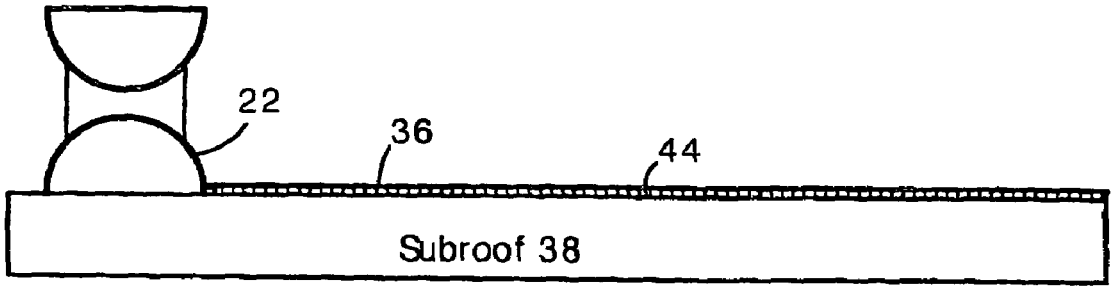
FIG. 7 shows a membrane roof having a porous layer between the membrane and subroof.

FIG. 7 shows an alternative embodiment of the membrane roof having a porous layer 44 disposed between the membrane and subroof. The porous layer 44 assures that the vent can evacuate air from all areas under the membrane. The porous layer can be made of a network of tubes, an open weave rigid fiber or similar materials. The porous layer can have a thickness of about ⅛ inch to 2 inches, for example.

Figure 8:
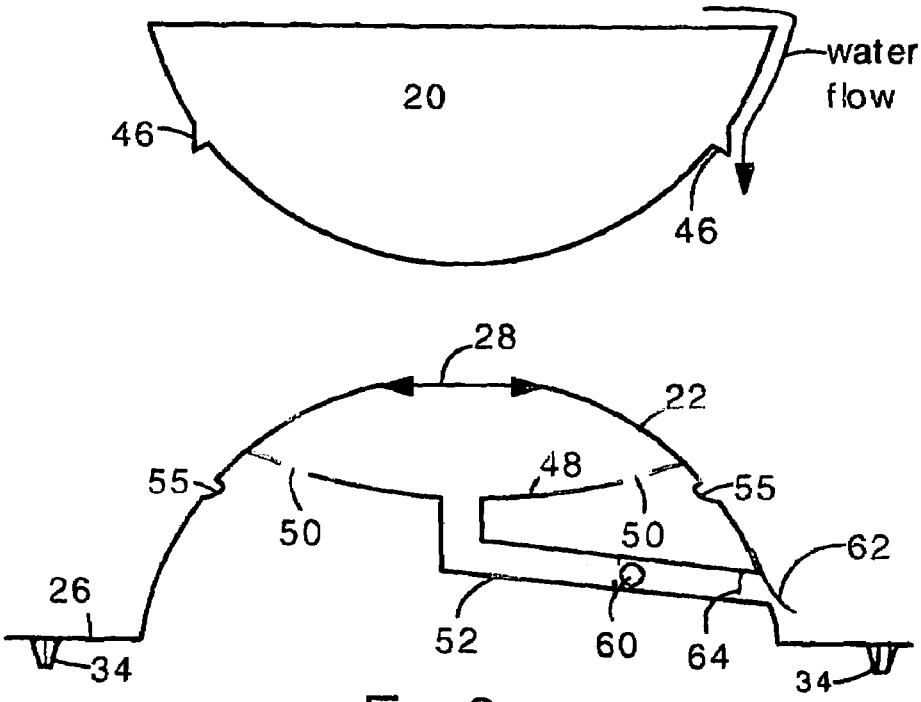
FIG. 8 shows an embodiment of the roof vent having features to prevent water from flowing under the membrane roof.

FIG. 8 shows another embodiment of the invention having features that prevent water from entering the vent and flowing under the membrane 36. Preferably, the present roof vent includes a drip edge 46 that circumscribes the upper dome. Droplets of water flowing down the sides of the upper dome are forced to drop from the drip edge 46, as illustrated by the arrow. Without the drip edge 46, droplets clinging to the upper dome 20 will drop into the lower dome 22 through the port 28.

Also, the present roof vent preferably includes a drip pan 48 disposed in the lower dome. The drip pan is located under the port 28. The drip pan 48 has holes 50 around its perimeter to allow airflow between the port 28 and the space under the membrane 36.

Also, the lower dome can include a drain 52 that collects water from the drip pan and passes it onto the roof. Alternatively, no drain is included, and the drip pan is cleared of water by evaporation. The drain 52 should include a check valve that allows water to flow from the pan but prevents air from entering the drain 52. The check valve can be a ball valve 60 or a flap 62. Alternatively, the drain can have a small orifice 64 that greatly reduces the amount of air that can enter the lower dome.

Additionally, the vent may include a rain diverter 55. The rain diverter 55 is an annular depression or ridge that circumscribes the lower dome. During high winds, water on the roof can be blown onto the lower dome 22 and possibly enter the port 28. The rain diverter 55 prevents this problem by diverting wind-blown water to travel around the lower dome. The rain diverter 55 can be a recessed area, as shown, or can be a raised ridge.

With the drip edge 46, drip pan 48, drain 52 and rain diverter 55, the amount of water that enters the lower dome will be greatly reduced or eliminated.

Figure 9:
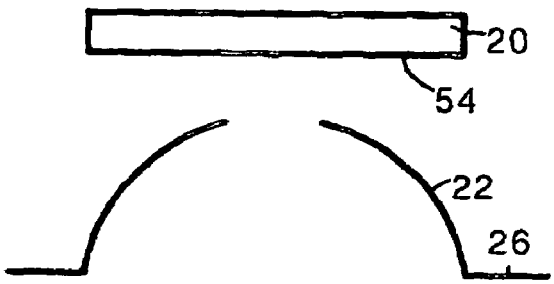
FIGS. 9 and 10 show alternative embodiments having flat surfaces.
Figure 10:
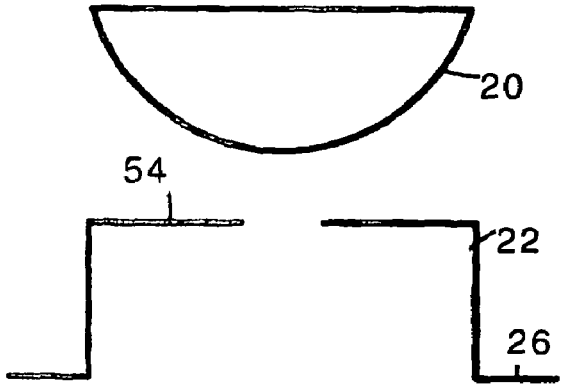

FIGS. 9 and 10 illustrate alternative embodiments of the present invention in which the lower dome or upper dome, respectively, have flat surfaces 54. The opposing dome has a convex surface. In the present invention, at least one dome must have a convex surface so that airflow is constricted as it passes between the domes and the Venturi effect occurs. Roof vents with a single flat surface are included within the scope of the appended claims.

Figure 11:
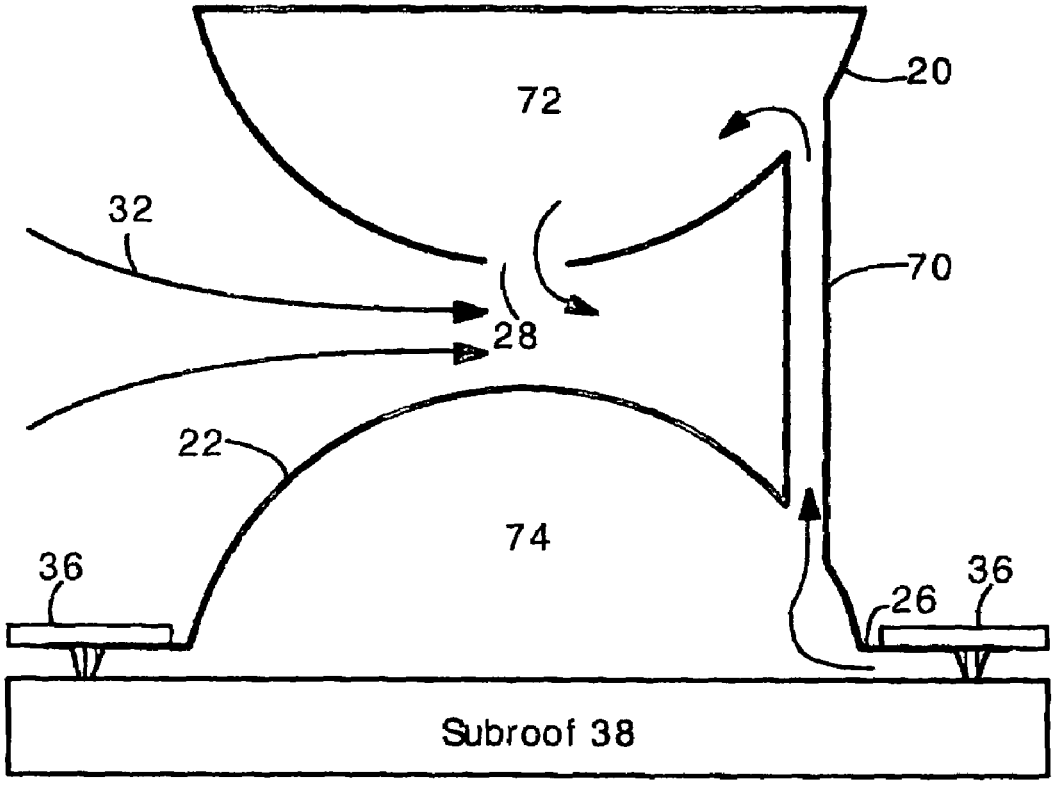
FIG. 11 shows a cross sectional view of an embodiment having a port in the upper dome.

FIG. 11 shows a cross sectional view of an alternative embodiment of the present invention in which the port 28 is located in the upper dome 20. The upper dome 20 is hollow. A hollow leg 70 supports the upper dome 20. The hollow leg 70 provides a fluidic connection between an interior 72 of the upper dome 20 and an interior 74 of the lower dome 22. The roof vent may also have 1 or 2 or more legs that also support the upper dome 20 (e.g. as illustrated in FIG. 1). Optionally, the roof vent can have more than one hollow leg supporting the upper dome 20 and providing a fluidic connection between the upper done 20 and lower dome 22. Preferably, the hollow leg 70 is large enough to provide a relatively unrestrictive airflow path between the upper and lower domes 20 22.

In operation, the roof vent of FIG. 11 works in essentially the same manner as the above-described embodiments. Wind 32 flowing between the domes 20 22 induces a reduced air pressure in the region of the port 28. The reduced air pressure causes air to flow from under the roof membrane 36, through the hollow leg 70 and out of the port 28. The membrane roof is thereby held against the subroof 38 during high wind events.

A significant advantage of the embodiment of FIG. 11 having the port 28 in the upper dome is that, since the port 28 opens downwardly, water infiltration through the port 28 is extremely unlikely. Water that does enter through the port 28 will immediately drain out onto the lower dome 22. It is nearly impossible for water to enter the roof by way of the hollow leg 70, since the hollow leg 70 extends above the port 28. Also, features such as the drip edge 46, drain 52, and the rain diverter 55 are unnecessary in the embodiment of FIG. 11.

Figure 12:
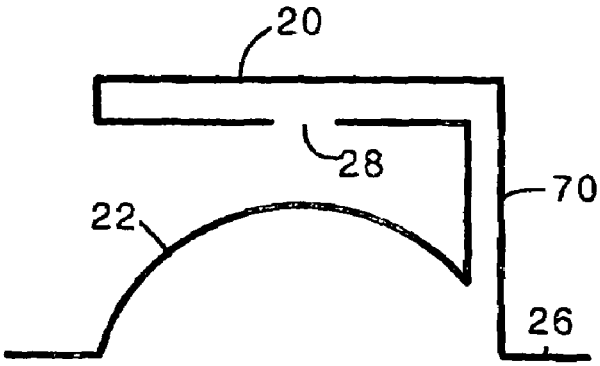
FIGS. 12 and 13 show alternative embodiments having flat surfaces, in combination with the port in the upper dome.
Figure 13:
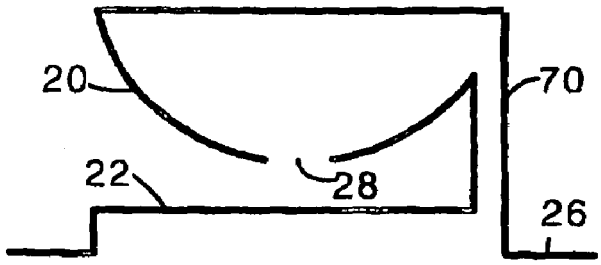

It is understood that either one of the upper dome 20 and lower dome 22 can have a flat surface. FIGS. 12 and 13, for example, show cross sectional views of embodiments having flat dome surfaces in combination with the port 28 located in the upper dome 20.

In the present membrane roof system, the roof vents should be spaced on a roof according to a grid pattern. For example, the roof vents can be spaced every 10, 20 or 30 feet in a rectangular or hexagonal grid. The proper spacing depends on the liftoff characteristics of the roof, the air flow characteristics of the space under the membrane, and the size and shape of the domes. The proper spacing for the roof vents can be determined empirically. Also, the present roof vents should not be located behind obstructions that can impede wind, such as parapets, short vertical walls, or chimneys. The present roof vents should be exposed to wind blowing over the roof.

It will be clear to one skilled in the art that the above embodiment may be altered in many ways without departing from the scope of the invention. Accordingly, the scope of the invention should be determined by the following claims and their legal equivalents.

What is claimed is:

1. A roof vent for use with membrane roofs, comprising:

a) a lower dome with a top surface;

b) an upper dome supported above the lower dome, wherein the upper dome has a bottom surface and a port in the bottom surface;

wherein the top surface and bottom surface face each other and are spaced apart;

wherein a distance between the top and bottom surfaces decreases from a periphery to a center of the vent; and c) a hollow leg supporting the upper dome, wherein the hollow leg provides fluid communication between an interior of the upper dome and an interior of the lower dome.

2. The roof vent of claim 1, further comprising a horizontal flange circumscribing a bottom of the lower dome.

3. The roof vent of claim 1, wherein the port is located where the distance between top and bottom surfaces is smallest.

4. The roof vent of claim 1, wherein one of the top surface and the bottom surface is substantially flat.

5. The roof vent of claim 1, wherein the top surface and the bottom surface are both convex.

6. A membrane roof, comprising:

a roof membrane with a hole;

a roof vent, comprising:

a) a lower dome with a top surface;

b) an upper dome supported above the lower dome, wherein the upper dome has a bottom surface and a port in the bottom surface;

c) a hollow leg supporting the upper dome, wherein the hollow leg provides fluid communication between an interior of the upper dome and an interior of the lower dome;

wherein the top surface and bottom surface face each other and are spaced apart; and wherein a distance between the top and bottom surfaces decreases from a periphery to a center of the vent.

7. The membrane roof of claim 6, further comprising a subroof disposed under the membrane, wherein the subroof includes grooves conductive to airflow.

8. The membrane roof of claim 6, further comprising a porous layer conductive to airflow under the membrane.

9. The membrane roof of claim 6, further comprising a horizontal flange circumscribing a bottom of the lower dome, wherein the flange is secured to the roof membrane in an area circumscribing the hole.

10. The membrane roof of claim 6, wherein the port is located where the distance between top and bottom surfaces is smallest.

11. The membrane roof of claim 6, wherein one of the top surface or the bottom surface is substantially flat.

12. The membrane roof of claim 6, wherein the top surface and the bottom surface are both convex.

13. A roof vent for use with membrane roofs, comprising of:

an upper dome having a bottom surface;

a lower dome aligned with said upper dome and having a top surface opposite said bottom surface of said upper dome, at least one of said upper and lower surfaces having a convex shape so that a portion of said at least one of said upper and lower surfaces curves toward the other of said upper and lower surfaces defining a wind gap therebetween; and an opening disposed in at least one of said upper and lower surfaces, wherein said wind gap is configured to allow wind to pass between said upper and lower surfaces, thereby reducing air pressure in said lower dome.

14. A roof vent according to claim 13, wherein at least one of said upper and lower domes is substantially enclosed.

15. A roof vent according to claim 13, wherein a plurality of supporting legs extend between said upper and lower surfaces.

16. A roof vent according to claim 13, wherein at least one of said upper and lower surfaces is substantially flat.

17. A roof vent according to claim 13, wherein both of said upper and lower surfaces are substantially convex.

* * * * *

UNITED STATES PATENT AND TRADEMARK OFFICE

CERTIFICATE OF CORRECTION

PATENT NO. : 7,607,974 B2
APPLICATION NO. : 11/177492
DATED : October 27, 2009
INVENTOR(S) : Jones et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1140 days.

Signed and Sealed this

Twelfth Day of October, 2010

David J. Kappos

David J. Kappos
*Director of the United States Patent and Trademark Office*